US005414604A

United States Patent [19]

Anderson

[11] Patent Number: 5,414,604

[45] Date of Patent: May 9, 1995

[54] LIGHT REFLECTOR WITH EDGE ILLUMINATION

[75] Inventor: Roger M. Anderson, Minneapolis, Minn.

[73] Assignee: Minnesota Mining and Manufacturing Company, St. Paul, Minn.

[21] Appl. No.: 149,295

[22] Filed: Nov. 9, 1993

[51] Int. Cl.[6] ..... F21S 3/00

[52] U.S. Cl. ..... 362/217; 362/349

[58] Field of Search ..... 362/217, 349

[56] References Cited

U.S. PATENT DOCUMENTS

| | | | |
|---|---|---|---|
| 2,194,841 | 3/1940 | Welch | 362/217 |
| 3,066,445 | 12/1962 | D'Amico | 362/217 |
| 4,078,169 | 3/1978 | Armstrong | 362/122 |
| 4,536,830 | 8/1985 | Wisniewski | 362/223 |
| 4,855,883 | 8/1989 | Spitz | 362/349 |
| 4,933,821 | 6/1990 | Anderson | 362/223 |

FOREIGN PATENT DOCUMENTS 0151850 8/1985 European Pat. Off. .

*Primary Examiner*—Carroll B. Dority

*Attorney, Agent, or Firm*—William L. Huebsch; Walter N. Kirn; Gary L. Griswold

[57] ABSTRACT

A reflector for a fluorescent fixture having an elongate generally cylindrically concave inner surface defining a cavity shaped so that all portions of a fluorescent lamp along the reflectivity axis are within the cavity. The inner surface of the reflector includes a specularly reflective major central portion that reflects a major portion of light emitted from the lamp generally normal to an imaginary plane across an outlet side of the cavity to illuminate an area beneath the fixture, and opposite reflective signal portions adjacent opposite sides of the reflector that each direct a minor portion of the light emitted by the lamp across the open side of the cavity and past the opposite edge of the inner surface to indicate to persons spaced from the illuminated area that the fluorescent lamp is emitting light.

16 Claims, 2 Drawing Sheets

LIGHT REFLECTOR WITH EDGE ILLUMINATION

This invention relates to specular or energy efficient reflectors used with fluorescent lamps that include means for illuminating along their edges to indicate that the lamp is turned on.

BACKGROUND OF THE INVENTION

Fluorescent strip light fixtures or industrial strip fixtures employing a diffuse white painted reflector emit light in almost every direction, including along the ceiling and toward the walls of a room being illuminated, in addition to toward the floor or work area intended to be illuminated. While such fixtures have been successfully used for years to provide light in a desired area, substantial amounts of light and energy are wasted by such fixtures due to the amount of light they direct toward areas, such as walls and/or windows and along the ceiling plane, where the light is not needed; the only significant benefit thereof being that persons outside of the area being illuminated will see light directed toward them through windows and/or reflected of walls, and will thereby know that the lights are turned on, which to potential customers of a store will indicate that the store is probably open.

To conserve energy, energy efficient light fixtures are now being used that include specular (i.e., mirror like and polished) reflectors that reflect light directly toward the area in which illumination is desired. Since such fixtures do not direct light along the ceiling and toward the walls and windows of a room, viewers outside the area being illuminated cannot readily ascertain whether the lights are turned on. This can cause a problem, for example, when such energy efficient lights are used in stores that remain open throughout the night. Business can be lost when potential customers, believing the store is closed because they can not tell that its lights are on, drive past the store without attempting to enter it.

U.S. Pat. No. 4,933,821 addresses this problem by providing illuminators for the opposite edges of a reflector that are illuminated when a fluorescent lamp within the reflector is emitting light, thereby indicating that the lamp is turned on. Generally, the edge illuminators of this invention each comprises a generally transparent or translucent illuminator body, and illuminator-mounting means adapted for mounting the illuminator body along the edges of the reflector so that the edge illuminators refract a portion of the light originating from the fluorescent bulb at a sharp angle with respect to the light reflected generally downwardly by the reflector to indicate to viewers along the sharp angle that the light is turned on. While such edge illuminators are effective, they add cost to the fixtures and interfere with placing the bottom edges of the fixtures flush with the surface of the ceiling, should that be desired.

SUMMARY OF THE INVENTION

The present invention provides an inexpensive and effective means for indicating to persons spaced from an illuminated area that the fluorescent lamps in energy efficient light fixtures illuminating the area are emitting light without the need for edge illuminators of the type described in U.S. Pat. No. 4,933,821.

According to the present invention there is provided a reflector for such an energy efficient fluorescent fixture having an elongate generally cylindrically concave inner surface defining a cavity, which inner surface has spaced parallel opposite edges defining an open outlet side for the cavity and has a longitudinal reflectivity axis midway between and parallel to the opposite edges and spaced into the cavity from an imaginary plane across the open side of the cavity defined by the edges so that all portions of a fluorescent lamp coaxially positioned along the reflectivity axis are within the cavity. The inner surface of the reflector includes a major specularly reflective central portion between its edges that is adapted to reflect a major portion of the light emitted from a fluorescent lamp coaxially positioned along the reflectivity axis in first directions generally normal to the reflectivity axis and generally normal to the imaginary plane defined by the two edges, and opposite reflective signal portions adjacent those edges each oriented so that a minor portion of the light emitted by a fluorescent lamp coaxially positioned along the reflectivity axis is directed by each signal portion across the open side of the cavity and past the opposite edge of the inner surface. Thus, when the reflector is positioned to direct light from a fluorescent lamp coaxialy positioned along the reflectivity axis downwardly toward an area to be illuminated, light reflected from the signal portions will indicate to persons spaced from the illuminated area in a direction generally normal to the edges of the inner surface that the fluorescent lamp is emitting light.

The opposite reflective signal portions adjacent those edges that direct light across the open side of the cavity and past the opposite edge of the inner surface can be specularly reflective to provide for their size the maximum signal that the lamp is on, or can be semi-specularly reflective or can be defuse reflectors should that be desired, such as to restrict glare from the signal portions.

BRIEF DESCRIPTION OF THE DRAWING

The invention will be further described with reference to the accompanying drawing wherein like reference numerals indicate like parts throughout the several views, and wherein.

DETAILED DESCRIPTION

Figure 1:
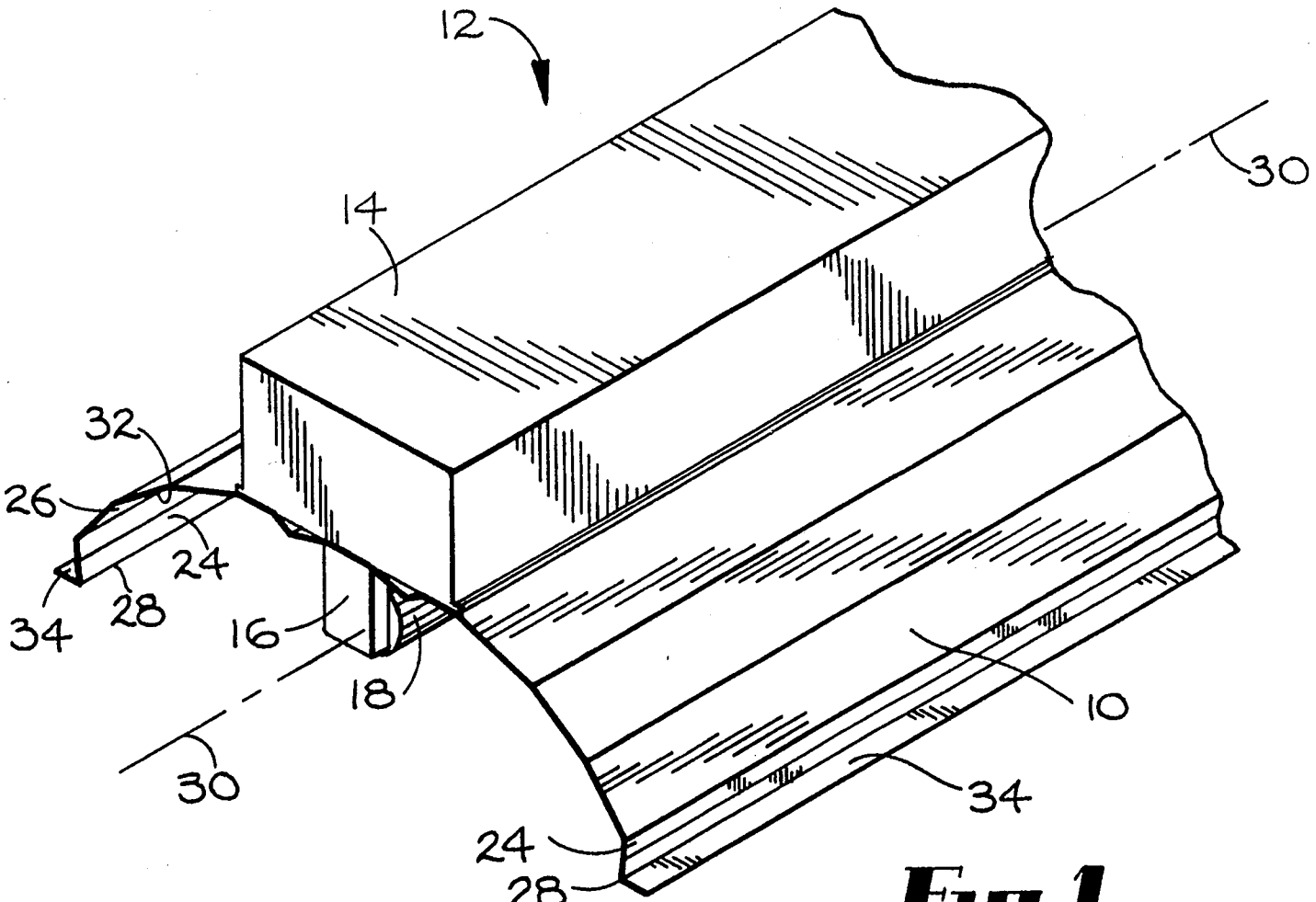
FIG. 1 is a fragmentary perspective view of a light fixture including a reflector according to the present invention.

Referring now to the drawing, there is illustrated a reflector 10 according to the present invention adapted to be incorporated in an elongate fluorescent light fixture 12 of the type that does not include a light diffuser. The light fixture 12 includes an elongate rectangular fixture housing 14, lamp-holding means provided by two opposed spaced conventional lamp-holders 16 (only one of which is shown) mounted on and depending from opposite ends of the fixture housing 14 for releasably holding and conducting electrical power to an elongate fluorescent lamp 18 having a central longitudinal axis, and the reflector 10 that is associated with the fixture housing 14 (e.g., by "associated with" we mean either fastened to the fixture housing 14, or fastened to structure to which the fixture housing 14 is also fastened).

Figure 2:
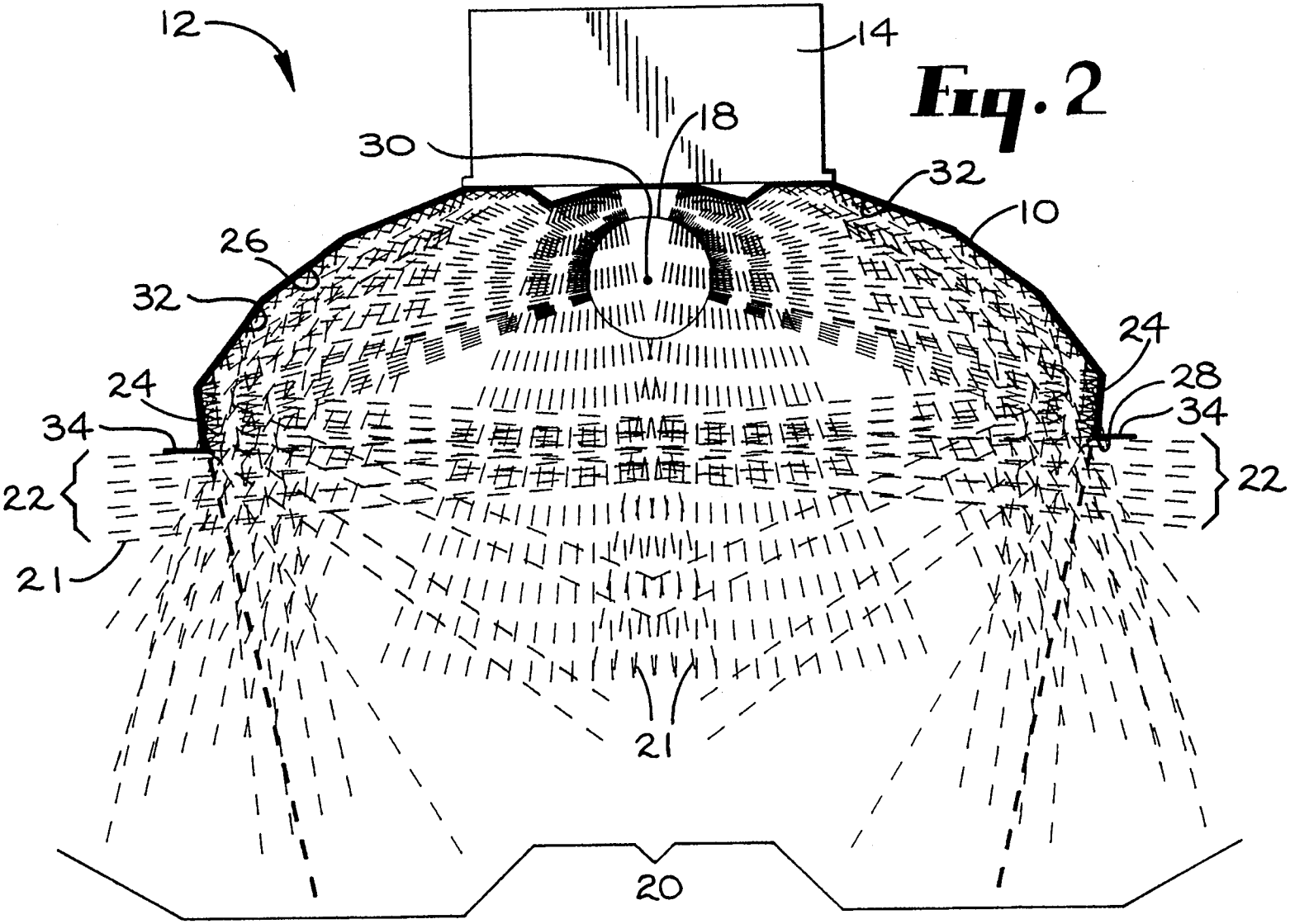
FIG. 2 is an enlarged end view of the reflector in the light fixture of FIG. 1 which illustrates the path of light rays emanating from a fluorescent light along a reflectivity axis for an inner surface of the reflector.

As can be seen in FIG. 2, when the fluorescent lamp 18 is illuminated, a major portion 20 of the light or light rays 21 emitted from the fluorescent lamp 18 is reflected by a specularly reflective central portion 32 of the reflector 10 substantially directly toward an area intended to be illuminated (e.g., directly downwardly toward the floor), however, minor portions 22 of the light emitted from the fluorescent lamp 18 will be reflected from reflective signal portions 24 of the reflector 10 to indicate to persons spaced from the illuminated area that the fluorescent lamp 18 is emitting light.

Generally, the reflector 10 according to the present invention for use in the light fixture. 12 has an elongate generally cylindrically concave inner surface 26 defining a cavity. The reflective inner surface 26 has spaced parallel opposite edges 28 defining an open outlet side for the cavity and has a longitudinal reflectivity axis 30 midway between and parallel to the opposite edges 28 and spaced into the cavity from the open side of the cavity so that all portions of a fluorescent lamp 18 coaxially positioned along the reflectivity axis 30 are within the cavity. The reflective inner surface 26 includes (1) the major specularly reflective central portion 32 that is centered between those edges 28 and is adapted to reflect the major portion (20) of the light emitted from the fluorescent lamp 18 coaxially positioned along its reflectivity axis 30 in first directions generally normal to the reflectivity axis 30 and generally normal to an imaginary plane across the outlet side of the cavity that is defined by the two edges 28 (i.e., in directions deviating from a 90 degree angle with respect to that imaginary plane by less than about 35 degrees), and (2) the opposite opposed reflective signal portions 24 between the central portion 32 and the edges 28 that are each oriented so that a different one of the small portions 22 of the light emitted by the fluorescent lamp 18 coaxially positioned along its reflectivity axis 30 is directed by each signal portion 24 across the open side of the cavity and past the opposite edge 28 of the inner surface 26. Thus, when the reflector 10 is positioned to direct light from a fluorescent lamp 18 coaxially positioned along its reflectivity axis 30 downwardly toward an area to be illuminated, light reflected from the signal portions 24 will indicate to persons spaced from the illuminated area in a direction generally normal to the edges 28 of the inner surface 26 that the fluorescent lamp 18 is emitting light.

The reflector 10 also includes flange portions 34 that project in opposite directions away from the edges 28. The flange portions 34 of the reflector 10 both provide rigidity for the edges 28 and, if desired, can be used to support the light fixture 12 above a structure such a suspended ceiling.

The signal portions 24 can be specularly reflective and disposed to direct the small portions 22 of the light emitted by the fluorescent lamp 18 at acute exit angles generally in the range of 2 to 20 degrees with respect to the imaginary plane defined by the two edges 28, with better results being achieved if the signal portions 24 are disposed to direct the small portions 22 of the light emitted by the fluorescent lamp 18 at acute exit angles generally in the range of 5 to 15 degrees with respect to that imaginary plane.

The signal portions 24 should have combined areas of less than about 20 percent of the total area of the inner surface 26, with combined areas for the signal portions 24 of less than about 12 percent of the area of the inner surface 26 being adequate.

As a non-limiting example, the reflector 10 can be formed of 0.020 inch or 0.050 centimeter thick aluminum to which is laminated a layer of the specularly reflective film commercially available from Minnesota Mining and Manufacturing Company (3M), St. Paul, Minn., under the trade designation "Silverlux film" that makes its inner surface 26 specularly reflective. FIG. 2 illustrates the contour of the inner surface 26 to scale, with the spacing between the edges 28 being about 10.78 inches or 27.37 centimeters, the axis 30 of reflectivity being spaced about 2.04 inches or 5.17 centimeters from the imaginary plane defined by the two edges 28, the signal portions 24 of the inner surface 26 being disposed at angles in the range of about 2 to 7 degrees with respect to the plane defined by the two edges 28, having a width normal to that plane of about 0.38 inches or 0.97 centimeters, and having a combined area that is approximately 10 percent of the entire area of the reflective inner surface 26.

The present invention has now been described with reference to one embodiment. It will be apparent to those skilled in the art that many changes can be made in the embodiments described without departing from the scope of the present invention. For example, instead of being made specularly reflective, the signal portions could instead be made semi-specularly reflective by applying over them a transparent or semi-transparent micro-layered polymeric material or a transparent or semi transparent light scattering material or the like (e.g., embossed or textured film, or film containing a light diffusing or light diffracting particle or pigment), or could be made diffusely reflective by, for example, coating the signal portions of the reflector with a light diffusing coating (e.g., white paint) or adhering a layer of light diffusing material over the signal portions of the reflector. The use signal portions that are semi-specularly reflective or diffusely reflective might be desirable, for example, to restrict glare from the signal portions in certain store environments. Thus the scope of the present invention should not be limited to the structures described in this application, but only by the structure described by the language of the claims and the equivalents thereof.

I claim:

1. A reflector having an elongate concave inner surface defining a cavity, said inner surface having spaced parallel opposite edges defining an open outlet side for said cavity and having a longitudinal reflectivity axis midway between and parallel to said opposite edges and spaced into said cavity from an imaginary plane across the open side of the cavity including the edges so that all portions of a fluorescent lamp coaxially positioned along said reflectivity axis are within the cavity, said inner surface being symmetrical about a central plane extending through said reflective axis and including a major specularly reflective central portion between said edges adapted to reflect a major portion of the light emitted from a fluorescent lamp coaxially positioned along said reflectivity axis in first directions generally normal to said reflectivity axis and generally normal to said imaginary plane, and opposite reflective signal portions adjacent said edges each angles inwardly toward said central plane and oriented to direct a minor portion of the light emitted by a fluorescent lamp coaxially positioned along said reflectivity axis across the open side of the cavity and past the opposite edge of the inner surface at acute exit angles generally in the range of 2 to 20 degrees with respect to said imaginary plane so that when the reflector is positioned to direct light from a fluorescent lamp coaxially positioned along said reflectivity axis downwardly toward an area to be illuminated, light reflected from the signal portions will indicate to persons spaced from the illuminated area in a direction generally normal to said edges of the inner surface that the fluorescent lamp is emitting light.

2. A reflector according to claim 1 wherein said signal portions are specularly reflective.

3. A reflector according to claim 1 wherein said signal portions are diffusely reflective.

4. A reflector according to claim 1 wherein said signal portions are semi-specularly reflective.

5. A reflector according to claim 1 wherein said signal portions are disposed to direct the minor portions of the light emitted by the fluorescent lamp at acute exit angles generally in the range of 5 to 15 degrees with respect to said imaginary plane.

6. A reflector according to claim 1 wherein said signal portions have areas of less than 20 percent of the area of the inner surface.

7. A reflector according to claim 1 wherein said signal portions have areas of less than 12 percent of the area of the inner surface.

8. A fluorescent light fixture comprising a fixture housing, lamp-holding means mounted on the fixture housing for releasably holding an elongate fluorescent lamp having a central longitudinal axis, and a reflector associated with the fixture housing, said reflector having an elongate concave inner surface defining a cavity, said inner surface having spaced parallel opposite edges defining an open side for said cavity and having a longitudinal reflectivity axis midway between and parallel to said opposite edges and spaced into said cavity from an imaginary plane across the open side of the cavity including said edges so that all portions of a fluorescent lamp axially positioned along said reflectivity axis are within the cavity, said inner surface being symmetrical about a central plane extending through said reflective axis and including a specularly reflective major central portion between said edges adapted to reflect a major portion of the light emitted from a fluorescent lamp coaxially positioned along said reflectivity axis in first directions generally normal to said reflectivity axis and generally normal to said imaginary plane, and reflective signal portions adjacent said edges each angles inwardly toward said central plane and oriented to direct a minor portion of the light emitted by a fluorescent lamp coaxially positioned along said reflectivity axis across the open outlet side of the cavity and past the opposite edge of the inner surface at acute exit angles generally in the range of 2 to 20 degrees with respect to said imaginary plane so that when said fixture housing and the reflector are positioned to direct light from a fluorescent lamp coaxially positioned by the lamp holding means along said reflectivity axis downwardly toward an area to be illuminated, light reflected from the signal portions will indicate to persons spaced from the illuminated area in a direction generally normal to said edges of the inner surface that the fluorescent lamp is emitting light.

9. A fixture according to claim 8 wherein said signal portions are specularly reflective.

10. A fixture according to claim 8 wherein said signal portions are diffusely reflective.

11. A fixture according to claim 8 wherein said signal portions are semi-specularly reflective.

12. A fixture according to claim 8 wherein said signal portions are disposed to direct the minor portions of the light emitted by the fluorescent lamp at acute exit angles generally in the range of 5 to 15 degrees with respect to said imaginary plane.

13. A fixture according to claim 8 wherein said signal portions have combined areas of less than about 20 percent of the area of the inner surface.

14. A fixture according to claim 8 wherein said signal portions have areas of less than about 12 percent of the area of the inner surface.

15. A fixture according to claim 8 wherein said first directions generally normal to said imaginary plane deviate from a 90 degree angle with respect to said imaginary plane by less than about 35 degrees.

16. A fixture according to claim 1 wherein said first directions generally normal to said imaginary plane deviate from a 90 degree angle with respect to said imaginary plane by less than about 35 degrees.

* * * * *